US008117711B2

(12) United States Patent
Stell

(10) Patent No.: US 8,117,711 B2
(45) Date of Patent: Feb. 21, 2012

(54) HIGH EFFICIENCY INTAKE HOOD SYSTEM FOR MOBILE SWEEPER VEHICLES

(75) Inventor: Edward B. Stell, New Market, AL (US)

(73) Assignee: Schwarze Industries, Inc., Huntsville, AL (US)

( * ) Notice: Subject to any disclaimer, the term of this patent is extended or adjusted under 35 U.S.C. 154(b) by 760 days.

(21) Appl. No.: 12/263,487

(22) Filed: Nov. 2, 2008

(65) Prior Publication Data

US 2009/0113660 A1 May 7, 2009

Related U.S. Application Data

(60) Provisional application No. 60/985,625, filed on Nov. 5, 2007.

(51) Int. Cl.
*E01H 1/08* (2006.01)

(52) U.S. Cl. ..... 15/340.1; 15/340.4; 15/346

(58) Field of Classification Search ..... 15/340.1–340.4, 15/346; *E01H 1/08*
See application file for complete search history.

(56) References Cited

U.S. PATENT DOCUMENTS 4,099,290 A * 7/1978 Hiszpanski ..... 15/346
4,660,248 A * 4/1987 Young ..... 15/340.1
6,070,290 A * 6/2000 Schwarze et al. ..... 15/340.1
6,161,250 A * 12/2000 Young et al. ..... 15/346
7,025,834 B2 * 4/2006 Joynt et al. ..... 134/21

* cited by examiner

*Primary Examiner* — David Redding
(74) *Attorney, Agent, or Firm* — Wallace G. Walter

(57) ABSTRACT

An improved pickup or intake hood for use in regenerative air flow road and pavement sweeper vehicles includes at least one side auxiliary plenums and/or at least one side-to-side plenum adjacent the primary air flow compartment. The auxiliary plenums are attached by appropriate ducting into the regenerative air flow so that any fugitive air and or dust flows from the primary air flow compartment are captured in the auxiliary plenums to minimize fugitive air and/or dust flows into the ambient atmosphere. Dust conduits from shrouded gutter brooms enter a manifold box to allow dust-entrained air flows from one or both gutter brooms to enter into the regenerative air flow to capture dust generated by the gutter brooms.

10 Claims, 10 Drawing Sheets

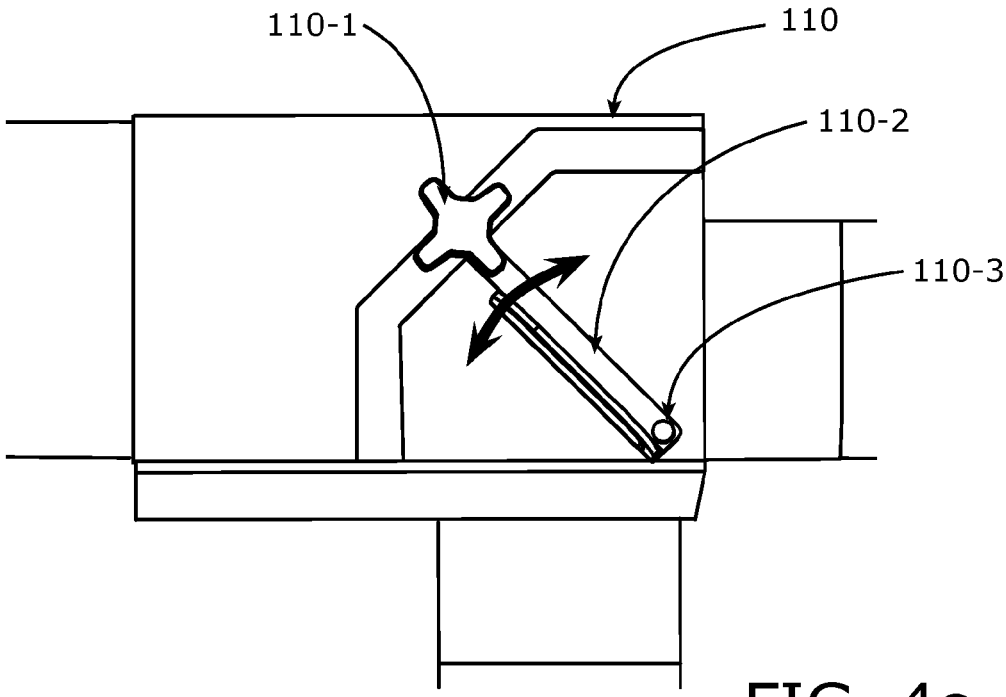
FIG. 4c
FIG. 4d
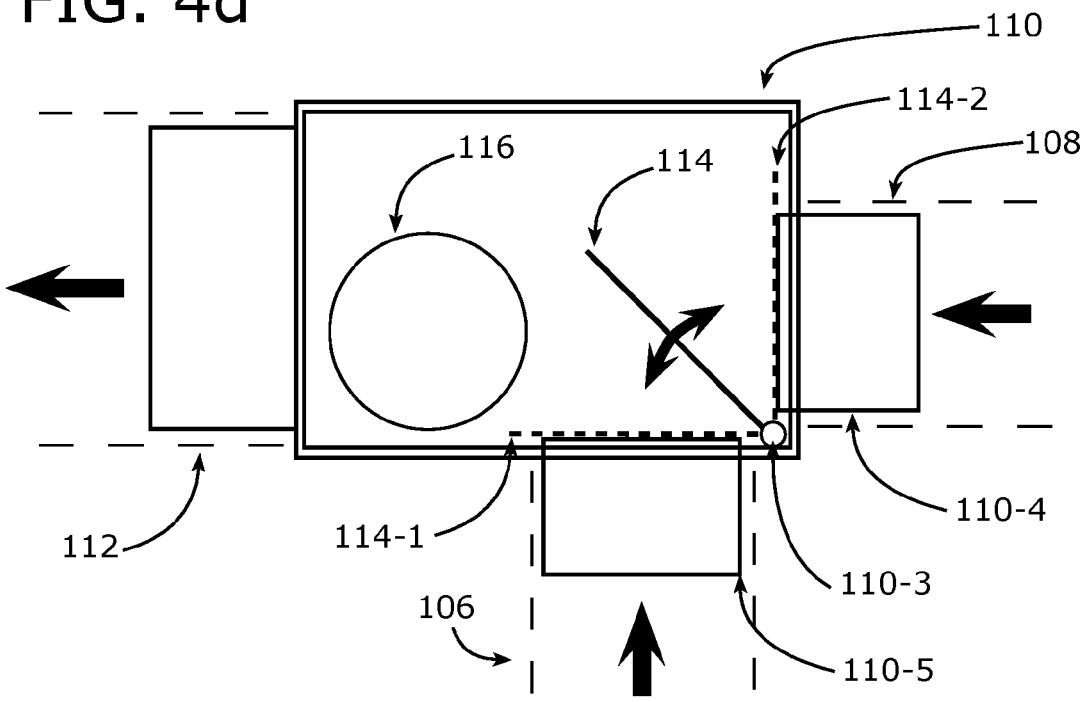

HIGH EFFICIENCY INTAKE HOOD SYSTEM FOR MOBILE SWEEPER VEHICLES

CROSS-REFERENCE TO RELATED APPLICATION

This application claims the benefit of U.S. Provisional Patent Application 60/985,625 filed Nov. 5, 2007 in common assignment herewith.

BACKGROUND OF THE INVENTION

Various types of vehicles have been developed to sweep or vacuum debris from pavements, roadways, and streets. In general, these vehicles can be classified as mechanical broom sweepers, air sweepers, and combinational variants thereof.

Mechanical broom sweepers use a motor-driven broom or brooms to mechanically sweep paper, plastic, litter, trash, vegetation (leaves, twigs, grass clippings, etc.), asphalt and concrete debris, and larger sand or gravel particles toward a conveyor for transport into a debris collection hopper.

Regenerative air sweepers use a motor-driven fan to create a high-velocity recirculating air flow to aspirate dust, particulates, and other debris from the pavement or street surface through an intake or pickup hood carried or suspended beneath the sweeper vehicle. Optionally, a gutter broom is often mounted adjacent one or both lateral sides of the intake hood to brush debris into the path of the intake hood, and a powered brush roll can be mounted with or contained within the intake hood to assist in dislodging particulates from the swept surface for entrainment into the air flow.

In a typical regenerative system, a motor-driven fan develops a high-volume, high-velocity recirculating air-flow through an intake or pickup hood that is positioned on or closely adjacent the pavement surface. As the intake hood is moved along the pavement surface, debris is aspirated into the air flow and carried by ducting into and through a debris-collecting hopper or container. As the debris-laden air enters the debris-collecting hopper, the velocity of the air flow is reduced sufficiently so that many particulates drop out the air stream with various types of baffles, screens, grates, panels, etc. causing additional particulates to drop out of the air flow and collect in the hopper.

It is known that some of the air flow in the intake hood can escape from beneath one or more of the various sides of the hood into the ambient environment; that escaping air flow can carry entrained particulates, known as 'fugitive' particles, into the ambient environment and undesirably contribute to the concentration of airborne particulates surrounding the cleaning vehicle. The issue of fugitive particles has been addressed by placing one or more elastomeric flaps or curtains along the perimeter edges of the intake hood; the flaps or curtains extend from the edges of the intake hood to the ground surface being sweep to minimize or otherwise limit the escape of fugitive air flows. Additionally, some systems are designed to vent some of the pressurized filtered air into the atmosphere prior to introduction into the intake hood to create a situation in which ambient make-up air is drawn into the intake hood to militate against the release of fugitive particulates. Since the volume of air introduced into the intake hood is large and the overall velocity of the primary air flow is large, subsidiary air flows can nonetheless be established that escape from beneath the intake hood.

SUMMARY

An improved pickup or intake hood for a roadway/pavement cleaning vehicle, such as a wheeled regenerative roadway/pavement sweeper, includes an intake hood having a central compartment into which air is introduced from the outlet of a recirculation fan at a high-velocity to entrain dust, particulates, and the like therein and from which the particulate-entrained air flow is provided via appropriate ducting to a dust separation system to remove the entrained material with the remaining air flow provided to the inlet of a recirculation fan. Dust conduits lead from appropriately shrouded gutter brooms into a flow control manifold or selector box that allows dust from one or both of the gutter brooms to be drawn into a duct for transport to the dust separation system. The intake hood is provided with at least one auxiliary compartment adjoining or adjacent the primary air flow compartment and into which any fugitive air flows from the primary air flow compartment can enter. The auxiliary compartment is in air flow communication with the dust separation system via ducting connected to the dust separation system so that any fugitive particulates are directed into the dust separation system to minimize the escape of fugitive dust and particulates.

BRIEF DESCRIPTION OF THE DRAWING

FIG. 4*c* is an enlarged top view of a flow-control selector or manifold shown in FIG. 4*a* and in FIG. 4*b;*

FIG. 4*d* is a top view of the flow-control selector or manifold of FIG. 4*c*, in partial cross-section, showing an internal adjustable vane;

DESCRIPTION OF THE PREFERRED EMBODIMENT

Figure 1:
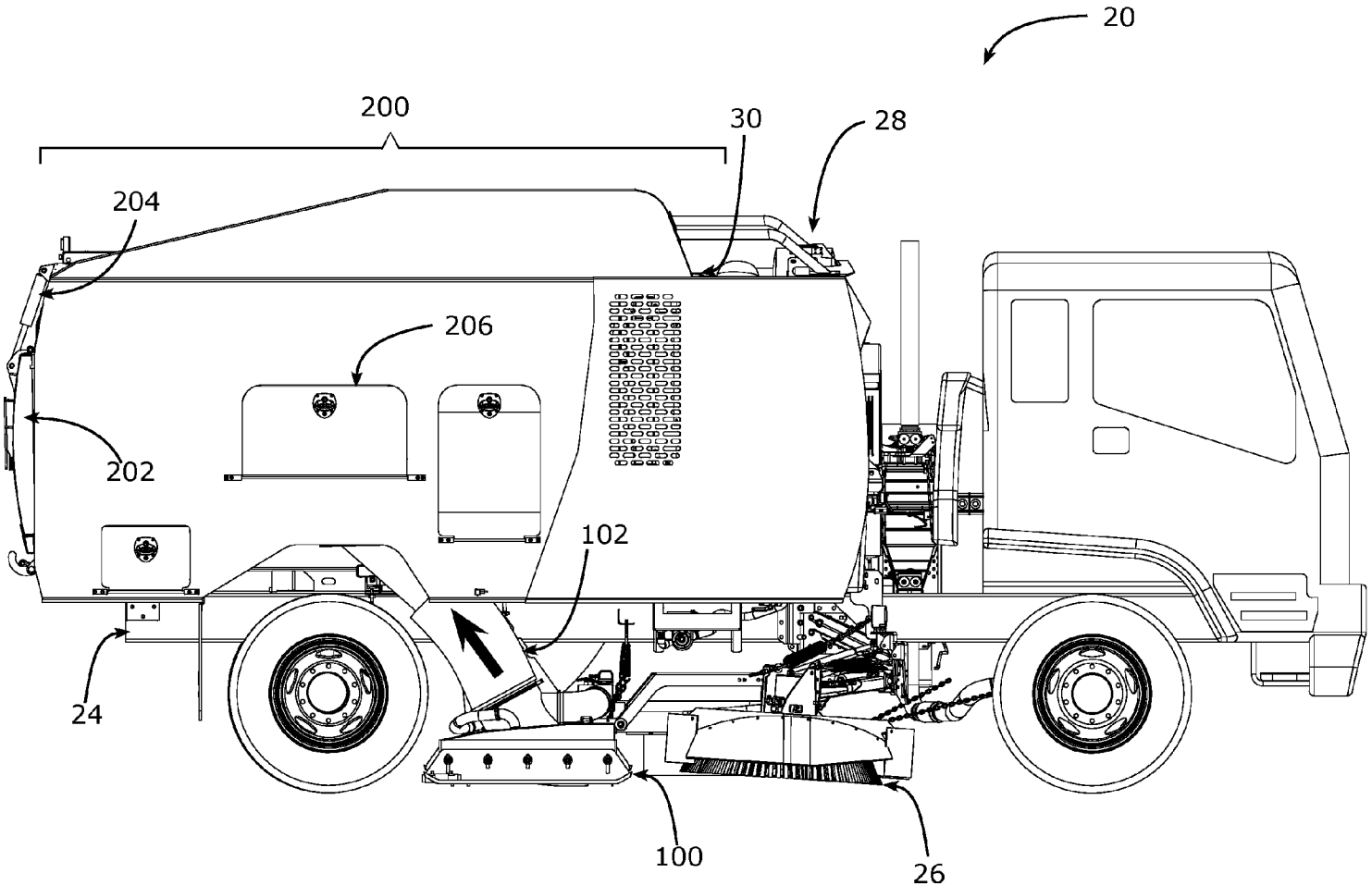
FIGS. 1 and 2 are right and left side elevation views of a sweeper vehicle in accordance with the present invention.
Figure 2:
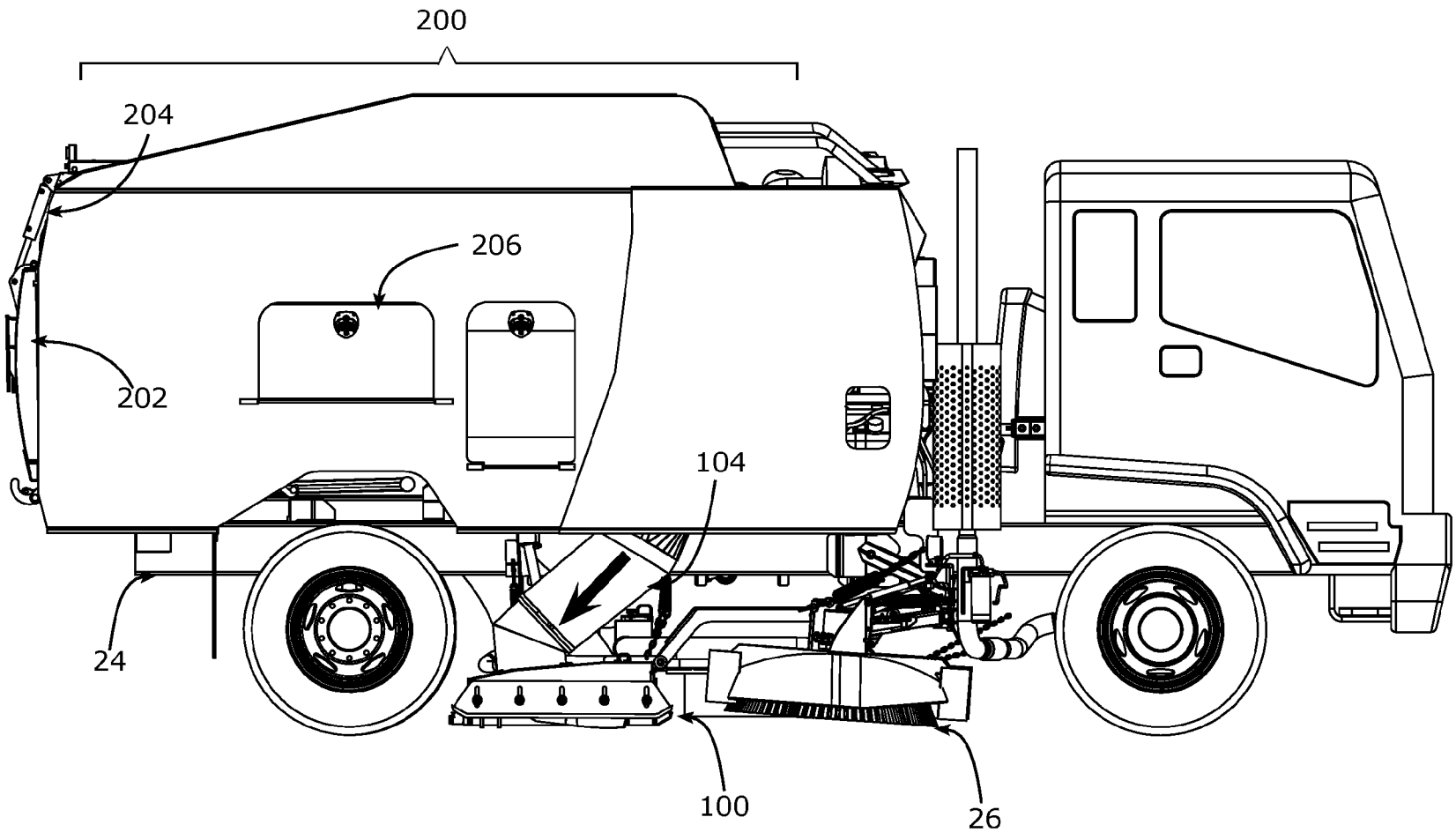

An exemplary pavement/street cleaning vehicle with a dust/particulate separation system in accordance with the preferred embodiment is shown in right and left side views in FIGS. 1 and 2 and is generally designated by the reference character 20; the particular sweeper configuration shown is representative of sweepers manufactured by Schwarze Industries, Inc. of Huntsville, Ala. 35811 under the DXR designation.

Figure 3:
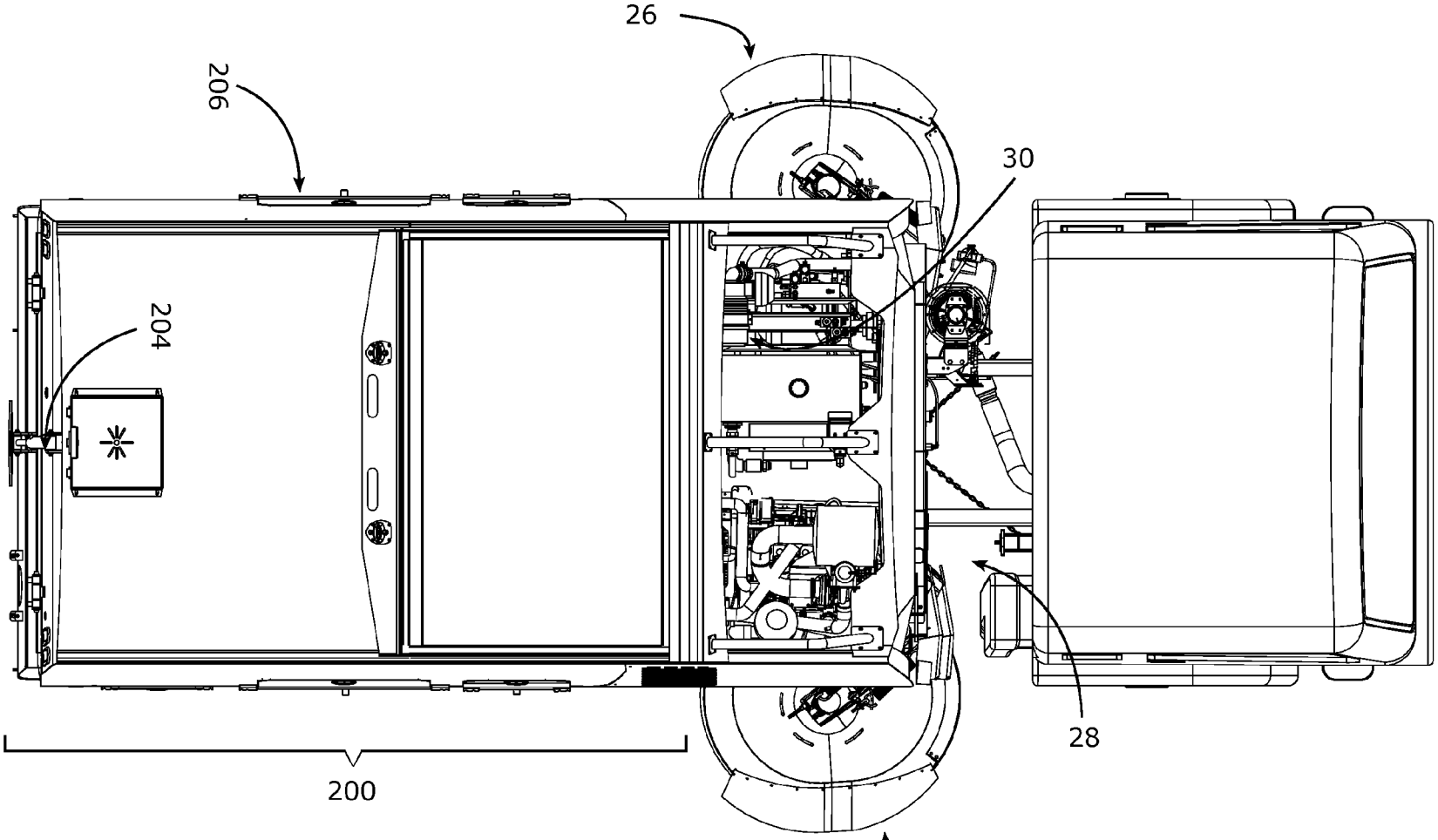
FIG. 3 is a top view of the sweeper shown in FIGS. 1 and 2.

As shown in FIGS. 1 and 2, the truck-mounted sweeper system 20, which can be mounted on a commercial truck chassis, includes a pickup head or debris-intake hood 100 carried beneath the truck frame 24, an optional gutter broom 26 that is mounted forwardly of the debris-intake hood 100 on one or both sides thereof (as shown in the top view of FIG. 3), and a power unit 28 that includes (not specifically shown) a high-volume, high-velocity radial flow fan 30, an internal combustion engine for driving the fan 30, and associated hydraulic pump(s), air compressor(s), and various accessory and related equipment as is known in the art. The radial flow fan 30 may take the form of the fan disclosed in U.S. patent application Ser. No. 09/528,168 filed Mar. 17, 2000 (now abandoned), the disclosure of which is incorporated herein by reference.

A debris separation system 200 is mounted rearwardly of the power unit 28 and functions as part of the air-flow recirculation loop to receive and accumulate debris that is aspirated or swept from the roadway surface. The debris separation system 200 includes a rear door 202 that is opened and closed by a hydraulic cylinder 204 as well as various inspection and/or access doors, generally indicated at 206.

As shown in FIG. 1, debris-laden air moves from the intake hood 100 through an intake duct 102 into the debris separation system 200 where particulates, dust, debris, etc. are separated. The air moves into the debris separation system 200 and through various baffles, grates, screens, etc. (not shown) to cause some of the entrained dust, particulates, etc. to drop out of the air flow. After passing through the debris separation system 200, the air is passed into and through the fan 30 and then through ducting 104 (FIG. 2) into the intake hood 100 to complete the air-flow recirculation loop. A filtered air bleed-off valve or port (not shown) is provided to bleed-off a measured quantity of the filtered air from the fan 30 into the ambient atmosphere to create a situation in which "make-up" air drawn from beneath the intake hood 100 into the recirculation air flow loop.

The intake hood 100 extends laterally substantially across the side-to-side width of the truck chassis from a driver side to the non-driver side of the vehicle. The intake hood 100 is typically suspended below the truck chassis 24 by links, bars, or chains (not specifically shown), or a combination thereof, so that the intake hood 100 can ride on or above the surface to be sweep as the sweeper vehicle 20 moves forward. As best shown in the plan views of FIGS. 4*a*, 4*b*, 5, and 10*a*, the intake hood 100 is configured as a generally rectangular structure having two shorter sides and two longer sides, one of the longer sides facing in the forward direction as indicated by the FWD arrows in the various figures. The intake hood 100 includes a primary air compartment 100-P (FIG. 8) into which air is introduced from the fan 30 to entrain at least some of any dust or particulates on the roadway surface for passage through the duct 102 to the debris separation system 200. After passage through the debris separation system 200, the air flow enters the fan 30 to continue the recirculation loop.

Figure 4A:
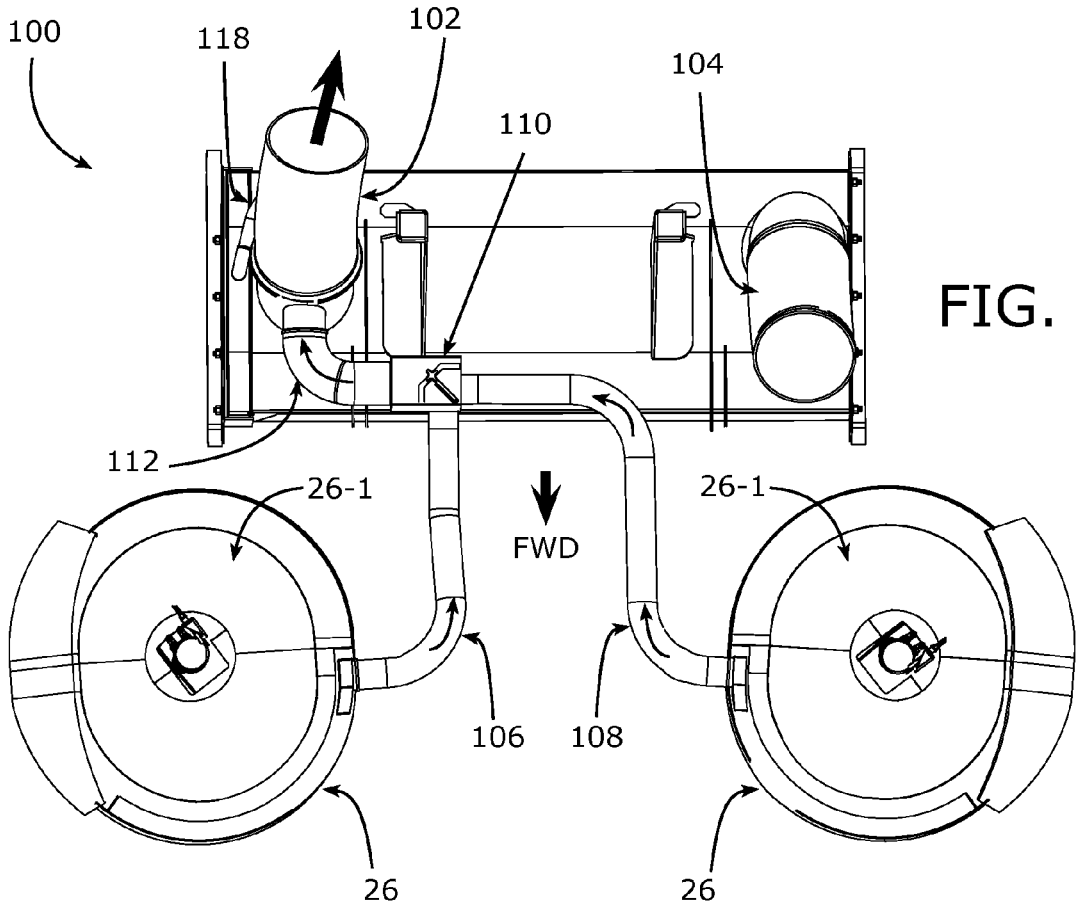
FIG. 4*a* is a top view of a first intake hood and gutter broom configuration.

As shown in FIG. 4*a*, the gutter brooms 26 are enclosed by appropriate shrouds 26-1 to control dust with dust conduits 106 and 108 (which can be fabricated from an elastomeric material or a resilient shape-sustaining semi-rigid plastic or plastic/metal combination) connected to a flow-control selector or manifold 110 that, in turn, connects via a conduit 112 into the intake duct 102. Thus, at least some of the dust/debris that is made airborne by the rotary motion of the gutter brooms 26 can be contained within their respective shrouds and transferred to and into the intake duct 102 for removal in the separation system 200.

Figure 4B:
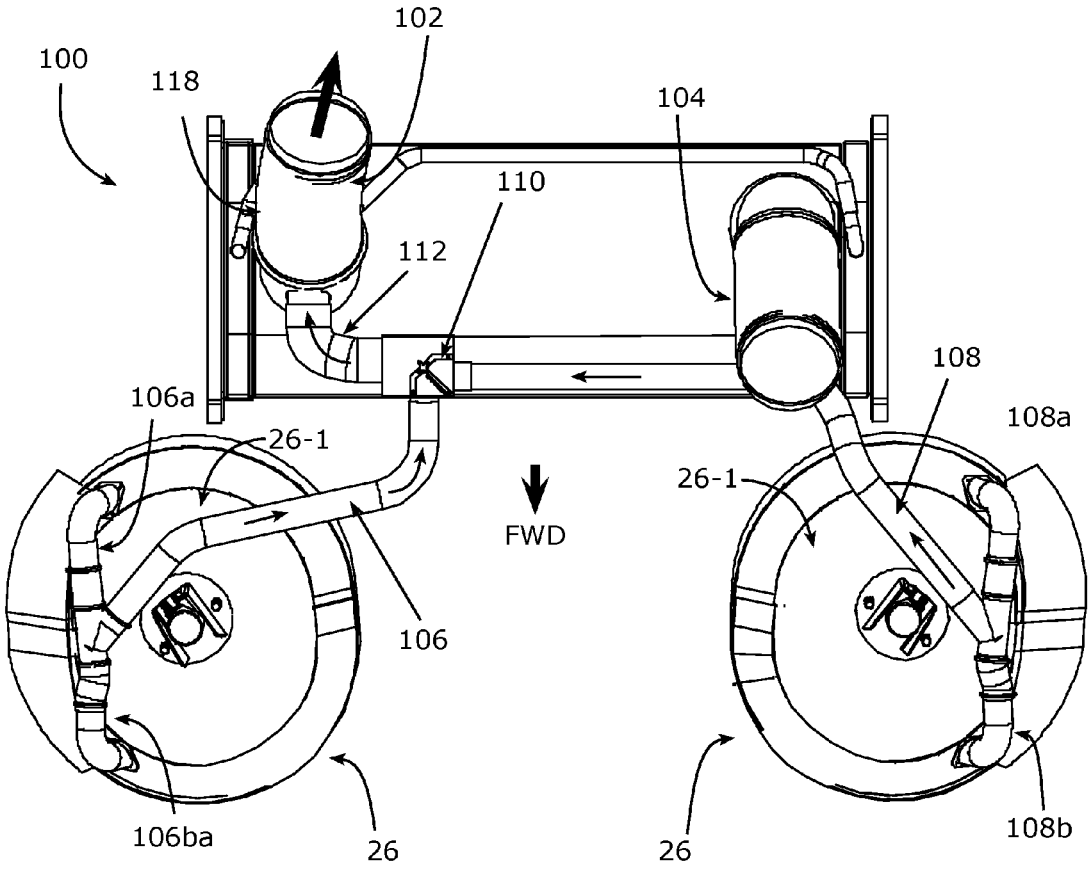
FIG. 4*b* is a top view of a second intake hood and gutter broom configuration.

FIG. 4*b* illustrates a second configuration for the gutter brooms 26 and the dust conduits 106 and 108 in which the each dust conduit is branched into two separate sub-ducts at the gutter broom 26. As shown, sub-ducts 106*a* and 106*b* join through a "Y" connection (unnumbered) into the duct 106, and sub-ducts 108*a* and 108*b* join through a "Y" connection (unnumbered) into the duct 108.

FIG. 4*c* is an enlarged plan view of the flow-control manifold 110 of FIG. 4 and shows a user operable knob 110-1 at or near the remote end of an indicator arm 110-2 that is attached of a pivot pin or axle 110-3. As explained in relationship to FIG. 4*d*, the operator can counter-rotate the knob 110-1 to unlock the indicator arm 110-2 to move the indicator arm 110-2 clockwise or counterclockwise to another position and rotate the knob 110-1 to tighten and lock the indicator 110-2 into its new position.

Figure 8:
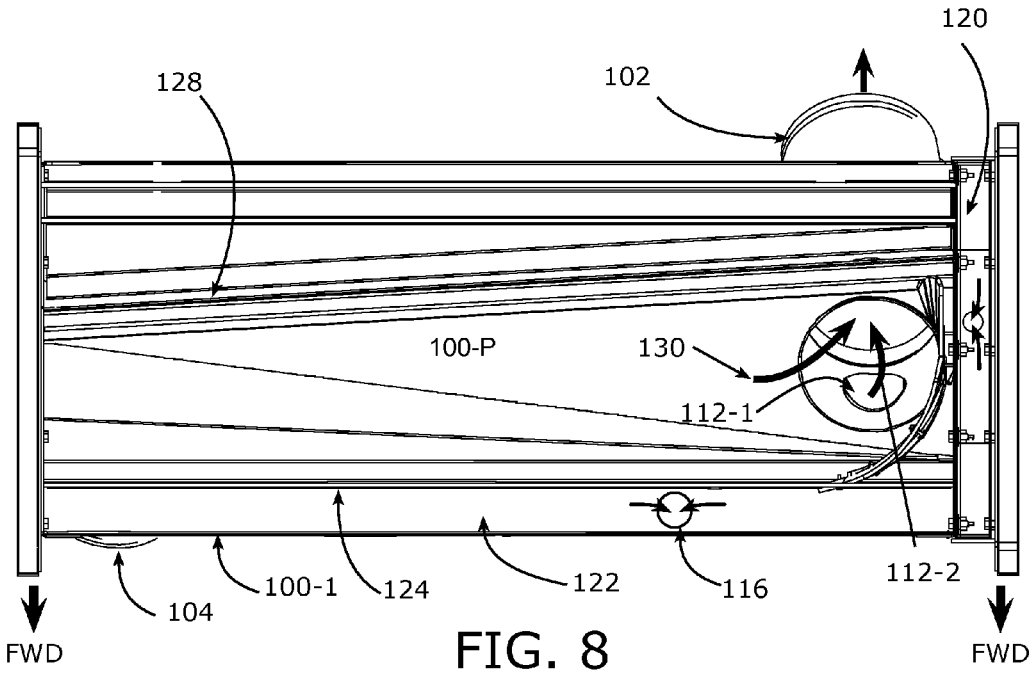
FIG. 8 is a bottom view of the intake hood of FIG. 6.

FIG. 4*d* is a plan view, in partial cross-section, of the flow-control manifold 110 of FIG. 4 and shows an internal axle-mounted panel or vane 114 that is connected to the indicator arm 110-2; the vane 114 is manually rotated counterclockwise to the left (as represented by dashed line 114-1) by the machine operator to substantially block flow from the conduit 106 so that flow from the conduit 108 is preferentially moved into and through the flow-control manifold 110 and through the ducting 112 into the intake duct 102. In a similar manner, the vane 114 can be rotated clockwise to the right (as represented by dashed line 114-2) by the machine operator to substantially block flow from the conduit 108 so that flow from the conduit 106 is preferentially moved into and through the flow-control manifold 110 and through the ducting 112 and into the intake duct 102. Is not necessary that the vane 114 completely block the air from the conduit 106 or 112; it is sufficient that a substantially majority of the flow is blocked from entering the manifold 110, since some "blow-by" is expected. As can be appreciated, when the vane 114 is in some intermediate position (as shown in solid line), air flow from both the ducts 106 and 112 will enter the manifold 110 since neither of the ducts 106 and 112 are no longer substantially blocked. Thus, when the gutter broom 26 on the left in FIG. 4*a* or 4*b* is sweeping against a curbstone, the vane 114 is positioned to substantially block flow from the conduit 108 to favor air flow from the left gutter broom 26 through conduit 106 into the intake duct 102 via the ducting 112, and, conversely, when the gutter broom 26 on the right in FIG. 4*a* or 4*b* is sweeping against a curbstone, the vane 114 is positioned to substantially block flow from the conduit 106 to favor air flow from the right side gutter broom 26 through conduit 108 into the intake duct 102 via the ducting 112. As shown in the view of FIG. 8, the ducting 112 connects to an opening 112-1 in the inlet ducting 102 with the arrow 112-2 representing the air flow thereinto.

Additionally, the flow-control manifold 110 includes an opening 116 that extends through the top surface or 'deck' of the intake hood 100 through to a forward auxiliary vacuum plenum or compartment 122, described below in relationship to FIGS. 7-10*b*.

In those cases where the vehicle is not equipped with gutter brooms 26 (for example, when sweeping leaves), the fittings 110-4 and 110-5 on the flow-control manifold 110 onto which the dust conduits 108 and 106, respectively, are attached can be closed off with caps (not shown) or appropriate plugs, for example. Where the vehicle is equipped with only one gutter broom 26, the appropriate fitting 110-4 or 110-5 with closed off with a cap.

Figure 5:
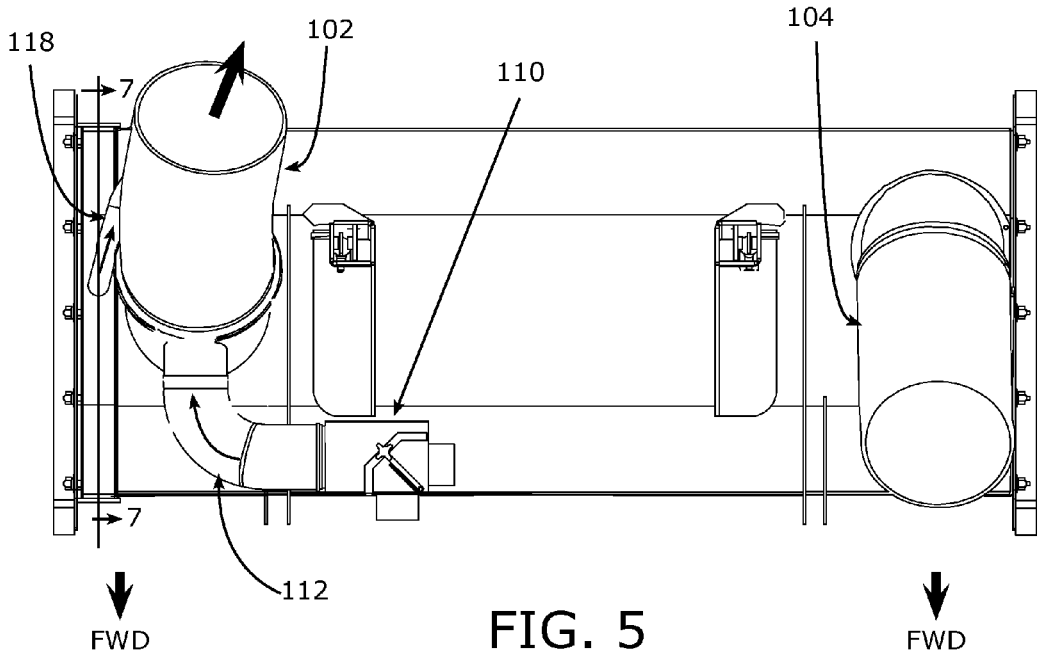
FIG. 5 is a top view of the intake hood of FIG. 4*a;*
Figure 6:
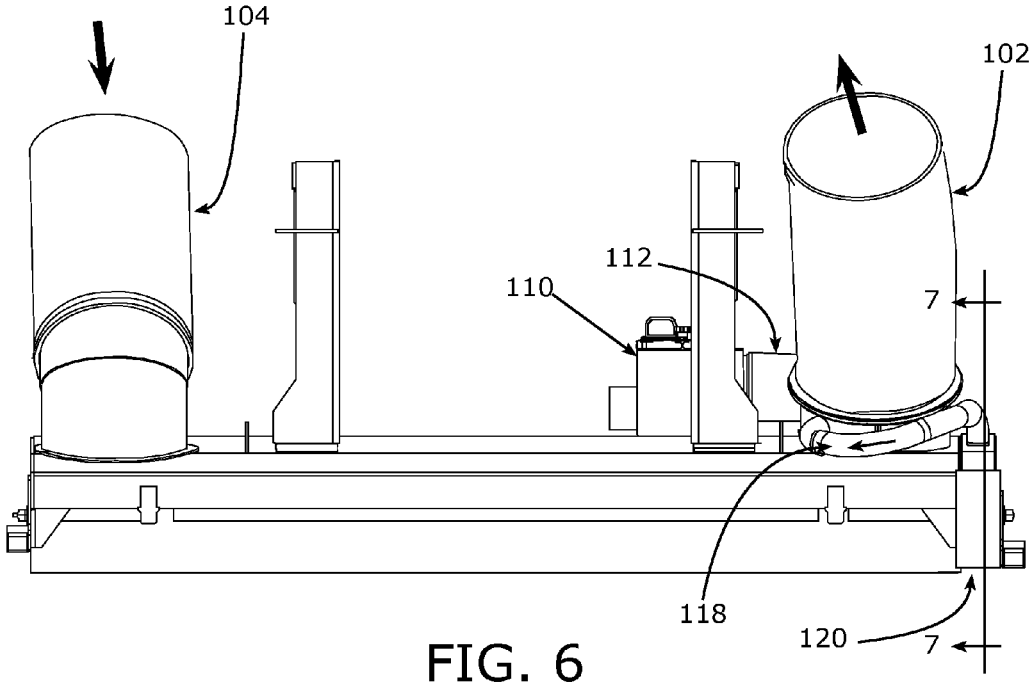
FIG. 6 is a rear elevational view of the intake hood of FIG. 5.
Figure 7:
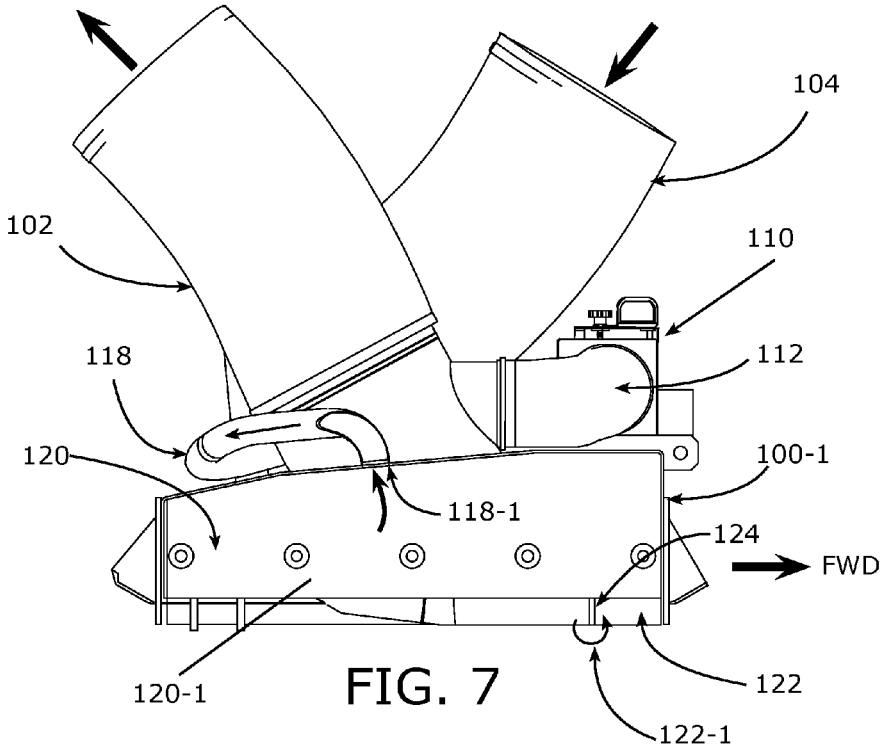
FIG. 7 is a side elevational view of the intake hood of FIG. 6, taken along line 7-7 of FIG. 6, with a side panel removed to reveal an interior compartment.
Figure 9:
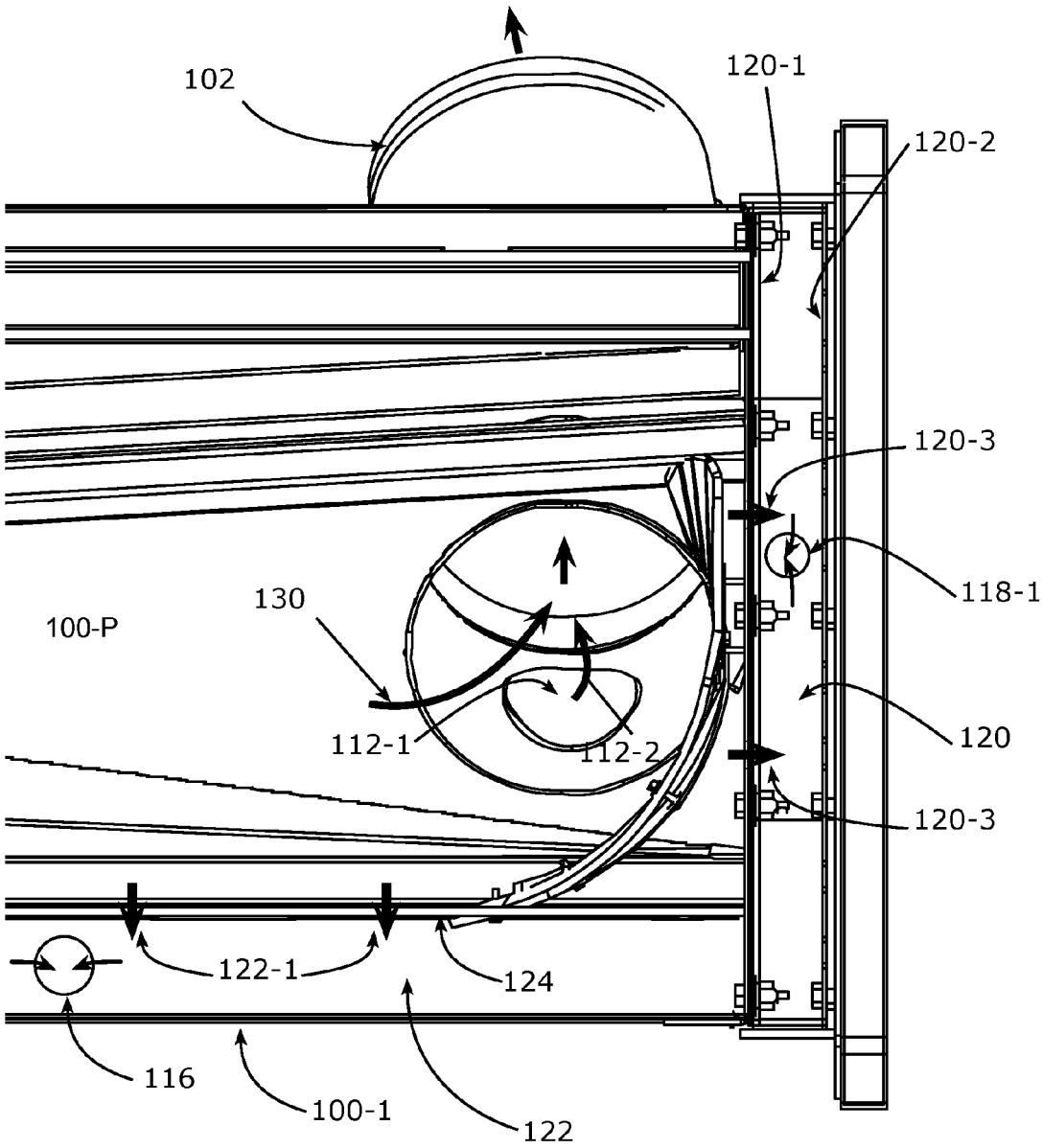
FIG. 9 is an enlarged view of the right side of the intake hood shown in FIG. 8.
Figure 10A:
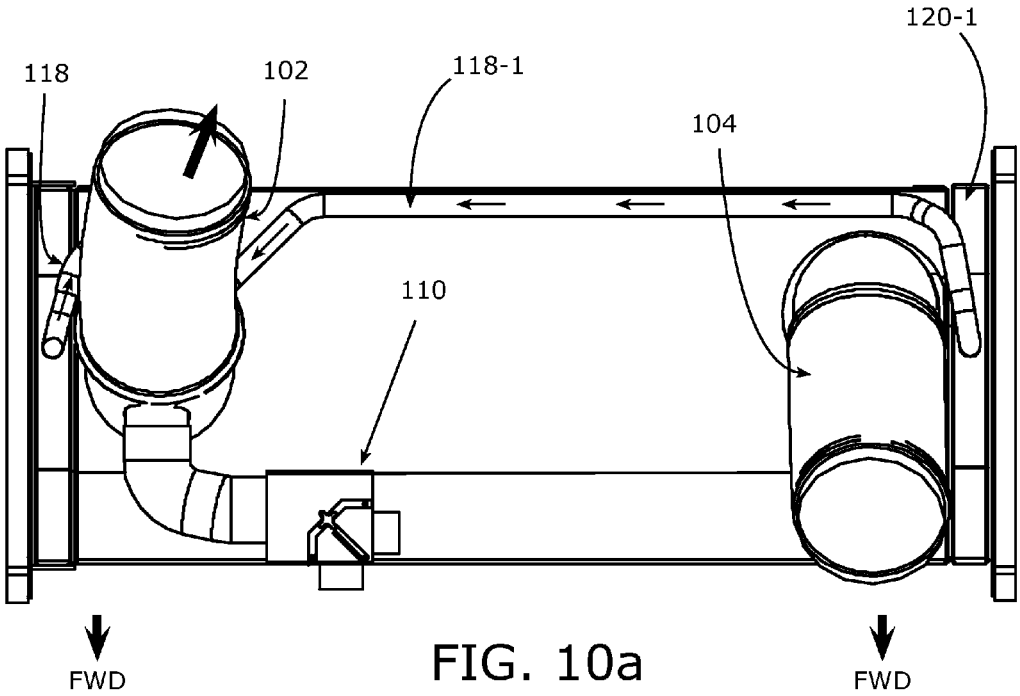
FIGS. 10*a* and 10*b* show the second intake hood configuration of FIG. 4*b* in top and bottom view.
Figure 10B:
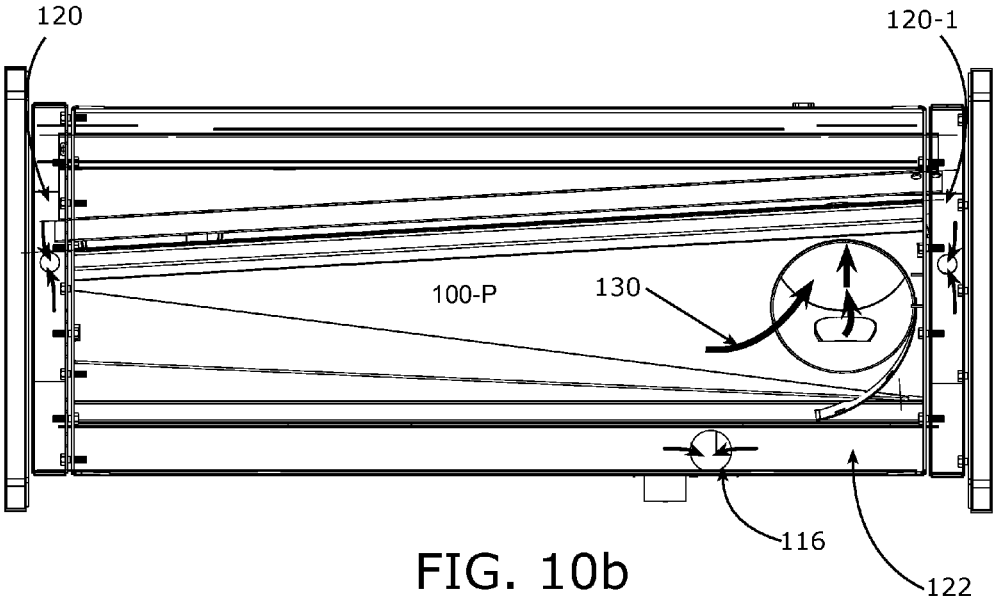

As shown on the left in the representative view of the intake hood 100 in FIG. 5, on the right in FIG. 6, and in the end view of FIG. 7, an auxiliary inlet conduit 118 connects the intake duct 102 to an auxiliary lateral or side plenum 120 in the intake hood 100 through an opening 118-1. The side plenum 120, which is shown in cross-section in FIG. 7 and in the bottom-side views of FIGS. 8 and 9, aspirates dust/particulates that enter into the side plenum 120 and through an opening 118-1 into the intake duct 102 via the auxiliary inlet conduit 118. Thus, as shown in FIG. 9, any fugitive air flows and any fugitive dust escaping from beneath the partition 120-1 enters into a volume from which an air flow is being continuous drawn via the conduit 118 into the intake duct 102 to thus minimize the escape of fugitive particulates.

As shown in FIGS. 7 and 8, a forward, laterally extending auxiliary vacuum plenum 122 is defined between the forward face 100-1 of the intake hood 100 and a partition 124 with the auxiliary vacuum plenum 122 communicating via the opening 116 (FIG. 4*b*) in the flow-control manifold 110 and a corresponding opening in the deck of the intake hood 100 with the conduit 112 and the intake duct 102. Thus, as shown in FIG. 7, any fugitive air flow or flows and any fugitive dust or particles escaping from beneath the partition 124 enter into the auxiliary plenum 122 and are continuously drawn via the opening 116 and the conduit 112 into the intake duct 102 to thus also minimize the escape of fugitive particulates from the primary air compartment of the intake hood 100.

The auxiliary plenums 120 and 122 thus each function to aspirate dust and particulates from the surface being swept and to also re-direct or capture any fugitive dust or particulates that may escape from the primary sweeping compartment.

FIGS. 5-9 show single auxiliary plenum 120 on one side of the intake hood 100; if desired and a shown in FIGS. 10 and 11, a second auxiliary plenum 120-1 can be provided on the opposite side of the intake hood 100 from that shown in FIG. 5 with a conduit 118-1 connecting that air flow to the intake duct 102. The various auxiliary plenums 120, 120-1, and 122 are shown as next to or immediately contiguous the shorter side or sides (plenums 120, 120-1) or the longer side (plenum 122) of the primary air flow chamber; as can be appreciated, the auxiliary plenums can be spaced from or somewhat adjacent the primary flow chamber provided the plenums are sufficiently close thereto to capture any escaping fugitive air flows or dust/particulates therefrom.

Filtered air enters the primary air flow compartment of the intake hood 100 via the filtered-air conduit 104 (from the outlet of the fan 30) and is forced through a narrow-width slot 128 to create an "air blade" or "air knife" that is effective to energized particulates on the pavement or roadway surface (including particulates within cracks and fissures) and aspirate or entrain the particles into the air flow beneath the intake hood 100 and then through the intake duct 102 as shown by the arrow 130. Any fugitive air flows from the primary air flow compartment of the intake hood 100 escaping therefrom into the lateral auxiliary plenum 120 (or 120-1, or both) or into the auxiliary plenum 122 are captured prior to escape into the ambient atmosphere.

The intake hood 100 shown in FIGS. 1 and 2 does not include an associated powered broom; if desired an intake hood with an integrated broom can be provided, for example, as described in U.S. Pat. No. 5,884,359 issued Mar. 23, 1999 to A. Llbhart, the disclosure of which is incorporated herein by reference.

The organization of the sweeper unit 20 is configured so that air flow through the intake hood 100 is from the driver side of the vehicle to the non-driver side of the vehicle, as is conventional in the industry. If desired, the sweeper can be configured so that air flow through the intake hood 100 is from the non-driver side to the driver side as disclosed in U.S. patent application Ser. No. 11/407,293 filed Apr. 20, 2006, the disclosure of which is incorporated herein by reference.

As will be apparent to those skilled in the art, various changes and modifications may be made to the illustrated embodiment of the present invention without departing from the spirit and scope of the invention as determined in the appended claims and their legal equivalent.

The invention claimed is:

1. An improved intake hood system for a wheeled roadway/pavement cleaning vehicle of the type having a debris-separation compartment and a fan for providing a recirculating air flow, an intake hood including first and second gutter brooms, the intake hood defined by at least one shorter side and at least one longer side with the longer side facing a forward direction, the intake hood including a first air-flow duct for passing an air flow from the fan into a primary air flow compartment within the intake hood for entraining at least some of any dust or particulates on the roadway/pavement therein and including a second air-flow duct for passing any air flow from the primary air flow compartment to the debris-separation compartment, the improved intake hood system comprising:

a dust shroud for each of the first and second gutter brooms;

a flow control manifold having a moveable flow control member therein;

a first dust conduit connected from the shroud of the first gutter broom to the flow control manifold for conducting any air flow from the first gutter broom thereinto;

a second dust conduit connected from the shroud of the second gutter broom to the flow control manifold for conducting any air flow from the second gutter broom thereinto;

a third dust conduit connecting the flow control manifold to the second air-flow duct to pass any air flow therein from the flow control manifold to the second air-flow duct;

the moveable flow control member of the flow control manifold moveable to at least a first position to substantially block any air flow from the first dust conduit into the flow control manifold to favor air flow from the second dust conduit and moveable to at least a second position to substantially block any air flow from the second dust conduit into the flow control manifold to favor air flow from the first dust conduit and moveable to a third position in which air flow from the first and second dust conduits are not substantially blocked.

2. The improved intake hood system of claim 1, further comprising:

an auxiliary air plenum contiguous with or adjacent the longer side of the intake hood and in air flow communication with the second air-flow duct through the flow control manifold.

3. The improved intake hood system of claim 1, further comprising:

an auxiliary air plenum contiguous with or adjacent the shorter side of the intake hood and in air flow communication with the second air-flow duct through an air flow tube.

4. The improved intake hood system of claim 1, further wherein the intake hood has first and second shorter sides and at least one longer side, further comprising:

a first auxiliary air plenum contiguous with or adjacent a one of the shorter sides of the intake hood and in air flow communication with the second air-flow duct through a first air flow tube; and a second auxiliary air plenum contiguous with or adjacent the other of the shorter sides of the intake hood and in air flow communication with the second air-flow duct through a second air flow tube.

5. The improved intake hood system of claim 1, further wherein the intake hood has first and second shorter sides and at least one longer side, further comprising:

a first auxiliary air plenum contiguous with or adjacent a one of the shorter sides of the intake hood and in air flow communication with the second air-flow duct through a first air flow tube; and a second auxiliary air plenum contiguous with or adjacent the other of the shorter sides of the intake hood and in air flow communication with the second air-flow duct through a second air flow tube; and a third auxiliary air plenum contiguous with or adjacent the longer side of the intake hood and in air flow communication with the second air-flow duct through the flow control manifold.

6. An improved intake hood system for a wheeled roadway/pavement cleaning vehicle of the type having a debris-separation compartment and a fan for providing a recirculating air flow, an intake hood defined by at least two shorter sides and at least one longer side with the longer side facing a forward direction, the intake hood including a first air-flow duct for passing an air flow from the fan into a primary air flow compartment within the intake hood for entraining at least some of any dust or particulates on the roadway/pavement therein and including a second air-flow duct for passing any air flow from the primary air flow compartment to the debris-separation compartment, the improved intake hood system comprising:

a first auxiliary air plenum contiguous with or adjacent the longer side of the intake hood and in air flow communication with the second air-flow duct.

7. The improved intake hood system of claim 6, further comprising:

a second auxiliary air plenum contiguous with or adjacent a one of the shorter sides of the intake hood and in air flow communication with the second air-flow duct.

8. The improved intake hood system of claim 7, further comprising:

a third auxiliary air plenum contiguous with or adjacent the other of the shorter sides of the intake hood and in air flow communication with the second air-flow duct.

9. An improved intake hood system for a wheeled roadway/pavement cleaning vehicle of the type having a debris-separation compartment and a fan for providing a recirculating air flow, an intake hood including first and second gutter brooms, the intake hood defined by at least two shorter sides and at least one longer side with the longer side facing a forward direction, the intake hood including a first air-flow duct for passing an air flow from the fan into a primary air flow compartment within the intake hood for entraining at least some of any dust or particulates on the roadway/pavement therein and including a second air-flow duct for passing any air flow from the primary air flow compartment to the debris-separation compartment, the improved intake hood system comprising:

a dust shroud for each of the first and second gutter brooms;

a flow control manifold having a moveable flow control member therein;

a first dust conduit connected from the shroud of the first gutter broom to the flow control manifold for conducting any air flow from the first gutter broom thereinto;

a second dust conduit connected from the shroud of the second gutter broom to the flow control manifold for conducting any air flow from the second gutter broom thereinto;

a third dust conduit connecting the flow control manifold to the second air-flow duct to pass any air flow therein from the flow control manifold to the second air-flow duct;

the moveable flow control member of the flow control manifold moveable to at least a first position to substantially block any air flow from the first dust conduit into the flow control manifold to favor air flow from the second dust conduit and moveable to at least a second position to substantially block any air flow from the second dust conduit into the flow control manifold to favor air flow from the first dust conduit and moveable to a third position in which air flow from the first and second dust conduits are not substantially blocked;

a first auxiliary air plenum contiguous with or adjacent a one of the shorter sides of the intake hood and in air flow communication with the second air-flow duct through a first air flow tube; and a second auxiliary air plenum contiguous with or adjacent the longer side of the intake hood and in air flow communication with the second air-flow duct through the flow control manifold.

10. The improved intake hood system of claim 9, further comprising:

a third auxiliary air plenum contiguous with or adjacent the other of the shorter sides of the intake hood and in air flow communication with the second air-flow duct.

* * * * *